United States Patent [19]

Hayden

[11] Patent Number: 4,606,738

[45] Date of Patent: Aug. 19, 1986

[54] RANDOMLY-ORIENTED POLYCRYSTALLINE SILICON CARBIDE COATINGS FOR ABRASIVE GRAINS

[75] Inventor: Stephen C. Hayden, Columbus, Ohio

[73] Assignee: General Electric Company, Schenectady, N.Y.

[21] Appl. No.: 479,118

[22] Filed: Mar. 31, 1983

Related U.S. Application Data

[63] Continuation of Ser. No. 249,756, Apr. 1, 1981, abandoned.

[51] Int. Cl.[4] ..... B24D 3/04; B24D 3/10

[52] U.S. Cl. ..... 51/295; 51/298; 51/307; 51/309

[58] Field of Search ..... 51/307, 295, 298, 309

[56] References Cited

U.S. PATENT DOCUMENTS

| | | | |
|---|---|---|---|
| 2,137,329 | 11/1938 | Boyer | 51/209 R |
| 2,216,728 | 10/1940 | Benner et al. | 51/298 |
| 2,561,709 | 7/1951 | Norling | 260/172 |
| 3,203,775 | 8/1965 | Cantrell | 51/296 |
| 3,385,684 | 5/1968 | Voter | 51/298 |
| 3,520,667 | 7/1970 | Taylor | 51/295 |
| 3,556,839 | 1/1971 | Roy | 427/217 |
| 3,617,347 | 11/1971 | Kuratomi | 427/215 |
| 3,664,819 | 5/1972 | Sioui et al. | 51/295 |
| 3,745,623 | 7/1973 | Wentorf et al. | 407/119 |
| 3,779,727 | 12/1973 | Siqui et al. | 51/298 |
| 3,894,673 | 7/1975 | Lowder et al. | 51/309 |
| 3,957,461 | 5/1976 | Lindstrom et al. | 51/295 |
| 4,024,675 | 5/1977 | Naidich et al. | 51/296 |
| 4,148,894 | 4/1979 | Hillig et al. | 428/242 |
| 4,174,971 | 11/1979 | Schrewelius | 106/44 |
| 4,184,853 | 1/1980 | Otopkov et al. | 51/295 |
| 4,220,455 | 9/1980 | St. Pierre et al. | 51/295 |
| 4,224,380 | 9/1980 | Bovenkerk et al. | 428/545 |
| 4,238,433 | 12/1980 | Hillig et al. | 264/60 |
| 4,242,106 | 12/1980 | Morelak | 51/307 |

OTHER PUBLICATIONS

Voice, "Coatings of Pyrocarbon and Silicon Carbide by Chemical Vapour Deposition", The Chemical Engineer, Dec. 1974.

Silicon Carbide-1973, Edited By Marshall, pp. 80-91, University of South Carolina Press, Columbia, South Carolina.

"Thermal Expansion-Nonmetallic Solids", Thermophysical Properties of Matter, Touloukin et al, TRPC Data Series, IFI/Phenum, New York-Washington, vol. 12, (1975), pp. 70-73 and vol. 13, (1977), pp. 19-21, 154-157 and 873-876.

*Primary Examiner*—James Derrington

*Attorney, Agent, or Firm*—Robert R. Schroeder

[57] ABSTRACT

Disclosed is a composite abrasive particle comprising a core abrasive crystal and a silicon carbide coating inherently bonded to substantially all of the exterior surfaces of said core crystal, said silicon carbide coating characterized by silicon carbide crystals having a random orientation substantially independent of the structure of the core crystal, the outer surface of the coating being conformationally irregular. Aggregates of the composite abrasive particles are interconnected by a matrix of silicon carbide which has an open structure. Preferred core abrasive crystals are diamond or cubic boron nitride. The composite abrasive particles preferably are made by infiltrating core crystals coated with non-diamond carbonaceous material with fluid silicon to produce a mass of core crystals bonded together by silicon carbide and elemental silicon, leaching substantially all of the silicon from the bonded mass with a silicon leaching agent, sub-dividing the resulting leached mass, and recovering the composite abrasive particles.

11 Claims, 6 Drawing Figures

RANDOMLY-ORIENTED POLYCRYSTALLINE SILICON CARBIDE COATINGS FOR ABRASIVE GRAINS

This application is a continuation of application Ser. No. 249,759, filed Apr. 1, 1981, now abandoned.

BACKGROUND OF THE INVENTION

The present invention relates to silicon carbide coated abrasive grains, such as diamond and cubic boron nitride, and more particularly to unique randomly-oriented polycrystalline silicon carbide coatings therefor.

Taylor (U.S. Pat. No. 3,520,667) proposes to coat diamond abrasive particles with an adherent surface coating of silicon carbide by suspending the diamond particles in a gaseous atmosphere of a volatile silicon compound which is thermally decomposed to form a silicon carbide coating on the diamond particles by reaction with the carbon present in the volatile silicon compound or added gaseus source of carbon. Kuratomi (U.S. Pat. No. 3,617,347) uses an analogous vapor deposition technique to coat diamond powder with a thin film of silicon carbide formed from the gaseous silicon compound and the diamond particle itself which thin silicon carbide coating then is recoated with elemental silicon. Silicon-based alloy coatings for abrasive grains have been proposed by Otopkov (U.S. Pat. No. 4,184,853) wherein the coating is a three-component system which includes silicon and two other metals selected from a recited group of metals, and by Caveney (U.S. Pat. No. 3,929,432) wherein a titanium alloy coats the diamond grain. U.S. Pat. No. 4,174,971 describes the in situ formation of silicon carbide by a pyrolysis process.

A prime use of these various coated abrasive particles is in the formation of grinding elements wherein the coated abrasive particles are bonded together with resin, metal, vitreous material, or the like. A prevalent problem in using such bonded coated abrasive particles is that the particles tend to pull out from the bonding matrix, thus resulting in decreased grinding performance and a loss of valuable abrasive particles. The coatings on the abrasive particles provide a degree of increased retention of the particles within the bonding matrix. Still, improvements in this art are needed.

BROAD STATEMENT OF THE INVENTION

One aspect of the present invention is a composite abrasive particle comprising a core abrasive crystal selected from the group of diamond and cubic boron nitride, and a silicon carbide coating adherently bonded to substantially all of the exterior surfaces of said core crystal. The improved silicon carbide coating is characterized by silicon carbide crystals having a random orientation substantially independent of the structure of the core crystal, the outer surface of the coating being conformationally irregular.

Another aspect of the present invention is a composite abrasive aggregate comprising core crystals selected from diamond, cubic boron nitride, and mixtures thereof, disposed within a silicon carbide matrix which matrix is adherently bonded to substantially all of the exterior surfaces of each of the core crystals. The silicon carbide matrix is characterized by silicon carbide crystals having a random orientation substantially independent of the structure of the core crystals. The matrix interconnecting said core crystals has an open structure and the outer surface of the matrix is conformationally irregular.

A method for making the composite abrasive particle described above comprises: providing core crystals coated with non-diamond carbonaceous material; infiltrating said crystals with fluid silicon under a partial vacuum at a temperature of above 1400° C., cooling and recovering the resulting mass of core crystals bonded together by a bonding medium of silicon carbide and elemental silicon, the outer surfaces of said core crystals having silicon carbide adherently bonded to substantially all of the exterior surfaces thereof; leaching substantially all of said silicon from said bonded mass with a silicon leaching agent; and subdividing (milling) the resulting leached mass and recovering said composite abrasive particles. Fibrous graphite can be provided in a uniform mixture with the coated core crystals to promote silicon infiltration.

There are two distinctions between the process as used to make the composite abrasive particles described above the composite abrasive aggregate. First, in the case of aggregates, the core crystals coated with non-diamond carbonaceous material should be tightly packed since a high degree of contact between the coated crystals is needed. This high packing density may be used in the case of the single particles as well, but is not required. The high crystal concentration also dictates that a minimum amount of fibrous graphite be used.

Secondly, and more importantly, to make aggregates, a relatively light or low energy milling (eg. less milling time) is required with sieving done more frequently to remove aggregates of the desired size (more than twice the size of the starting core crystals). To obtain just coated diamond or CBN, a more vigorous milling can be used with sieving done at a size only slightly larger than the core crystal. For example, starting with 140/170 mesh (106/90 micron) diamond, silicon carbide coated diamond would be sieved out in the 100/120 mesh (150/125 micron) size while aggregates would be obtained by not milling beyond about 40/60 mesh (425/250 microns).

Another aspect of the present invention is an improved abrasive element of coated abrasive particles embedded in a bonding matrix. The improvement is that said coated abrasive particles comprise a core abrasive crystal selected from the group of diamond and cubic boron nitride, and a silicon carbide coating adherently bonded to substantially all of the exterior surfaces of the core crystal, said silicon carbide coating characterized by silicon carbide crystals having a random orientation substantially independent of the structure of said core crystal, the outer surface of said coating being conformationally irregular. Additionally, the coated abrasive particles in the improved abrasive element can comprise composite abrasive aggregates wherein the silicon carbide coated core abrasive crystals are interconnected by a silicon carbide matrix having an open structure. The preferred bonding matrix can be selected from the group of resin, metal, and vitreous material, and the preferred abrasive element is a grinding element.

Advantages of the present invention include a silicon carbide coating which is tightly bonded to the core particle which provides excellent mechanical bonding in the bonding matrix. Also, the unique silicon carbide coating of the present invention provides a highly wear-resistant region, intermediate between the core abrasive crystal and the bonding matrix, around each abrasive grain which reduces loss of the coated crystal by chip erosion during use of the abrasive element. Further, the composite abrasive aggregates of the present invention have an open structure between silicon carbide coated grains which, when filled with bonding matrix material during abrasive element fabrication, provides for a positive locking of the aggregate in the bonding matrix. Additionally, since no metal coating is contained on the composite abrasive particles or aggregates of the present invention, the silicon carbide coating can be added at the expense of additional secondary abrasive in the abrasive element without detrimental effects even at higher concentrations of the coated abrasive particles in the abrasive element. These and other advantages will become readily apparent to those skilled in the art based upon the disclosure herein contained.

DETAILED DESCRIPTION OF THE DRAWINGS

Figure 1A:
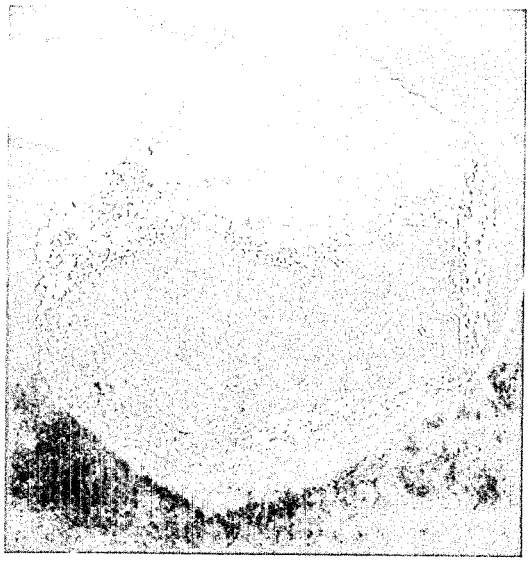
FIGS. 1A, 1B, and 1C are photomicrographs at three different magnifications (100×, 500×, and 1500×, respectively) of the randomly-oriented polycrystalline silicon carbide coated diamond grains of the present invention.
Figure 1B:
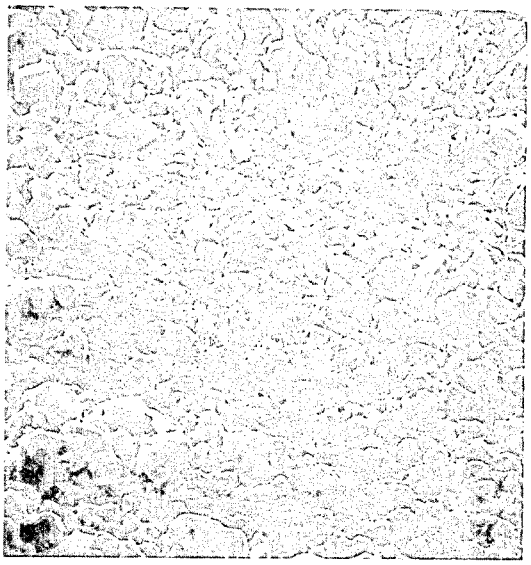
Figure 1C:
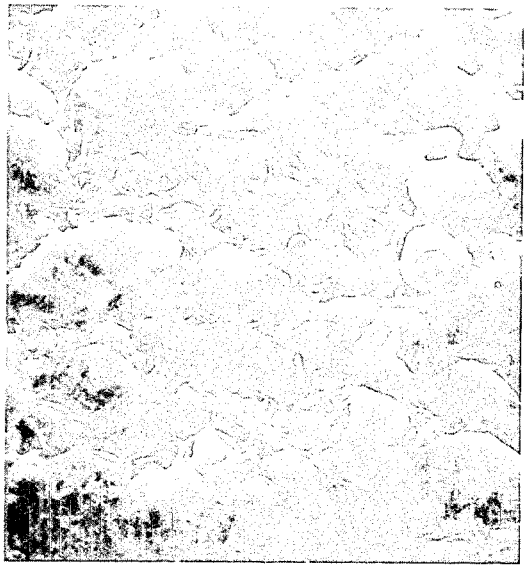
Figure 2A:
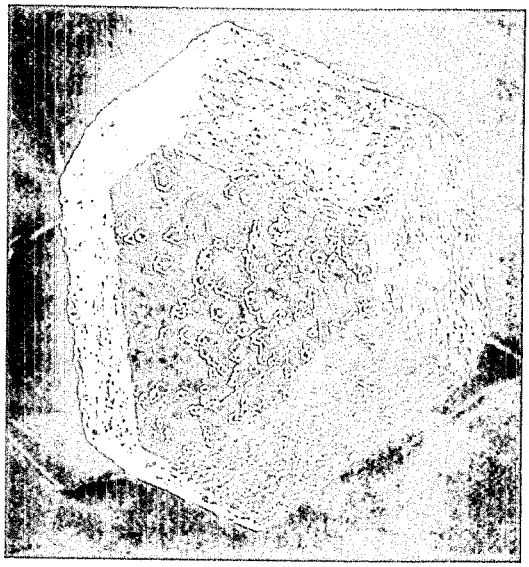
FIGS. 2A, 2B, and 2C are photomicrographs at three different magnifications (100×, 500×, and 1500×, respectively) of comparative silicon carbide coated diamond grains.
Figure 2B:
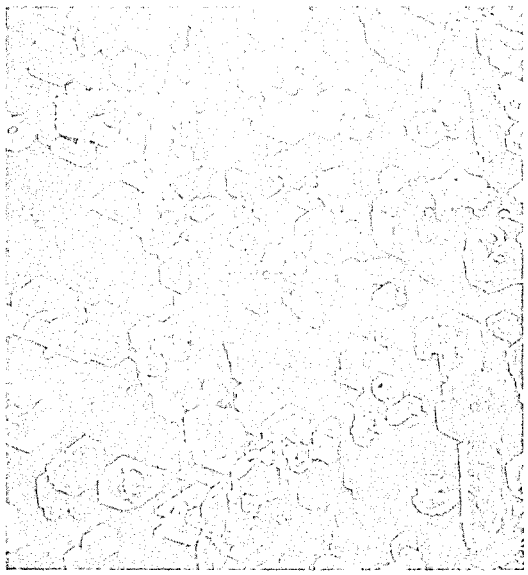
Figure 2C:
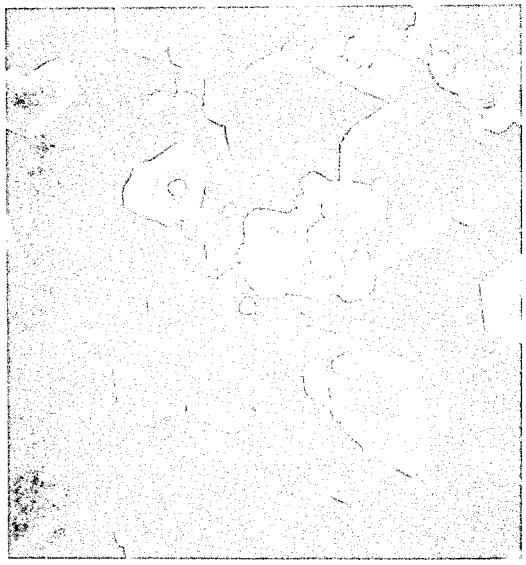

The comparative silicon carbide coated diamond particles shown in FIGS. 2A–2C were made by the preferred infiltration, leaching, and subdividing process of the present invention, except that the diamond grains were uncoated, i.e. not coated with non-diamond carbonaceous material so that the silicon carbide coating was formed by a chemical reaction of diamond carbon with silicon. The silicon carbide coated diamond particles in FIGS. 1A–1C were made by the preferred method of the present invention wherein the diamond grits were coated with a non-diamond carbonaceous material for infiltration thereof with fluid silicon. Note the relatively smooth outer surface of the comparative particles and the apparent related orientation of the silicon carbide crystals of the coating. This is to be contrasted with the exterior surface of the novel particles of the present invention wherein an apparently total random orientation of the silicon carbide crystals can be seen. The silicon carbide crystals on the novel particles also appear to be much smaller in overall exterior dimensions (eg. about 0.1–10 microns) than the silicon carbide crystals of the comparative particles.

Note further that the different faces of the core diamond crystal are distinctly defined for the comparative particles. The comparative particles also display a relationship or ordered pattern between the diamond surface which supplied the carbon and the formed silicon carbide crystals. Note the silicon carbide crystal shape and orientation in FIG. 2A on the octahedral (6-sided) surfaces compared to the cubic (4-sided) surfaces. This illustrates the dependence of the coating surface upon the underlying diamond surface which supplied the carbon atom for the formation of silicon carbide. On the other hand, the exterior surface of the novel particles of the present invention exhibit a completely random orientation of silicon carbide crystals independent of the underlying diamond surface. The outer surface of the novel particles also is conformationally irregular and extremely rough in texture. The random orientation of the silicon carbide crystals on the novel coated particles of the present invention apparently stems from the fact that the silicon carbide nucleation arises from the silicon carbide crystals of the coating rather than from the diamond core particle. Apparently, nucleation of the silicon carbide crystals on the comparative samples during their formation is based on the core diamond particle itself. Also, since nucleation of the silicon carbide in the coating of the novel particles is based upon the silicon carbide crystals in the coating itself, excellent intercrystal silicon carbide crystal bonding is displayed by the novel coated particles of the present invention. Based upon the texture and arrangement of the silicon carbide crystals of the coatings of the two different particles shown in the photographs, one would expect that the novel coated particles of the present invention could be bound in a matrix to a much better degree than the comparative coated crystals. In fact, this has been demonstrated to be true as the example will amply demonstrate.

DETAILED DESCRIPTION OF THE INVENTION

Referring to the preferred method for making the composite abrasive particles and aggregates of the present invention, the preferred core abrasive crystal is selected from the group consisting of diamond, cubic boron nitride, and mixtures thereof when making the novel abrasive aggregates of the present invention. It must be recognized, though, that any abrasive particle (eg. silicon carbide itself, aluminum oxide, etc.) may serve as the core abrasive crystal for coating with silicon carbide according to the precepts of the present invention. In view of the crystal arrangement and morphology of the silicon carbide crystals in the coating as shown in the drawing, it is apparent that the source of carbon for forming the silicon carbide coating should not come from the core abrasive crystal itself, but rather an external source of carbon should be used. Thus, the core abrasive crystals are provided with a coating of non-diamond carbonaceous material. The particle size range for the preferred diamond and cubic boron nitride abrasive crystals range from about 325/400 to 60/80 mesh (U.S. standard sieves series) (45/38 to 250/180 microns) with particles about 100/120 mesh and smaller being preferred. Coating of the core crystals with non-diamond carbonaceous material and the silicon infiltration step of the present process desirably are practiced according to the general procedure disclosed in U.S. Pat. No. 4,220,455. Note that somewhat similar processes also are disclosed in U.S. Pat. Nos. 4,148,894; 4,238,433; and 4,242,106.

The carbonaceous material can be elemental non-diamond carbon, an organic material, or mixtures thereof. The organic material decomposes completely at an elevated temperature below 1400° C., and ordinarily decomposes completely at a temperature ranging from about 50° C. to about 1200° C., to produce elemental non-diamond carbon and gaseous product of decomposition.

Representative of the organic materials useful in the present process are polymers of aromatic hydrocarbons such as polyphenylene and polymethylphenylene, derivatives of polynuclear aromatic hydrocarbons contained in coal tar such as dibenzanthracene and chrysene. Additional examples of useful organic materials are the epoxy resins such as the reaction product of epichlorohydrin and Bisphenol-A. Still additional examples of useful organic materials are phenolic resins obtained by the condensation of phenol or substituted phenols with aldehydes such as formaldehyde, acetaldehyde, and furfural. Specific examples are the condensation products of phenol-formaldehyde, resorcinol-formaldehyde, aniline-formaldehyde, and cresol-formaldehyde.

The non-diamond carbonaceous material coated core crystals next are infiltrated with fluid silicon under partial vacuum at a temperature of above 1400° C., preferably using the apparatus and general procedure shown and described in U.S. Pat. No. 4,220,455. While the coated core crystals can be admixed with additional carbon for infiltrating with silicon, such is not necessary in forming the silicon carbide coated composite abrasive particles of the present invention. As noted in U.S. Pat. No. 4,220,455, the coated core crystals and a source of silicon are heated to an infiltration temperature which is above 1400° C. When the carbonaceous material coating the core crystals is an organic material, such organic material decomposes completely at a temperature below 1400° C. producing elemental non-diamond carbon and gaeous products of decomposition.

Infiltration is carried out at a temperature above 1400° C. at which silicon becomes fluid and which has no significant deleterious effect on the crystals. For cubic boron crystals infiltration temperatures significantly higher than about 1450° C. are not useful since they are likely to cause conversion to hexagonal boron nitride. On the other hand, for diamond crystals, temperatures higher than 1550° C. provide no significant advantage. By a temperature at which silicon becomes fluid it is meant herein a temperature at which the silicon is readily flowable. The fluid silicon is highly mobile and highly reactive with elemental non-diamond carbon, i.e. it has an affinity for elemental non-diamond carbon, wetting it and reacting with it to form silicon carbide. Specifically, when silicon is at its melting temperature, which has been given in the art to range from about 1412° C. to about 143° C., it has a high viscosity, but as its temperature is raised, it becomes less viscous and at a temperature about ten degrees higher than its melting point, it becomes fluid. The temperature at which the silicon is fluid is the temperature at which it will infuse or infiltrate through the capillary-size passages, interstices or voids of the mold-confined mixture of crystals. With increase in temperature, the flowability of the fluid silicon increases resulting in a faster rate of reaction.

Sufficient silicon is infiltrated throughout the mold-confined mass or mixture, infusing or infiltrating through the voids or pores of the mixture by capillary action to react with the total amount of elemental non-diamond carbon (including fibrous graphite) present in the confined mixture forming silicon carbide, and also to fill any pores or voids which may remain after formation of the silicon carbide. Any pores remaining after formation of silicon carbide are filled during infiltration with elemental silicon. Also during infiltration, the silicon reacts with the elemental non-diamond carbon coating on the surfaces of the crystals forming a protective adherent coating of silicon carbide on the diamond surfaces and causing no loss or no significant loss of crystal and no change or no significant change in the shape and dimensions of the crystals. The resulting infiltrated mass is cooled in an atmosphere which has no significant deleterious effect on said infiltrated mass, preferably it is furnace cooled in the partial vacuum to about room temperature, and the resulting polycrystalline body is recovered.

The period of time for full infiltration by the silicon is determinable empirically and depends largely on the size of the shaped mixture, and frequently, infiltration by the fluid silicon through the mold-confined shaped mixture is completed within about 15 minutes.

The cooled and recovered resulting mass of core crystals bonded together by a bonding medium of silicon carbide and elemental silicon then is subjected to the action of a silicon leaching agent for leaching substantially all of the silicon from the resulting bonded mass. The silicon leaching agent generally is a suitable acid with a mixture of nitric and hydrofluoric acids in a volume ratio of 9:1, respectively, being preferred. The leaching operation desirably is practiced by immersion of the bonded mass in the silicon leaching agent which may be held at room temperature or more preferably at a temperature between about 100° and 120° C. Note that sequential leaching of the bonded mass or on subdivided portions of the bonded mass may be practiced as is necessary, desirable, or convenient.

The leached bonded mass is quite friable and is composed primarily of silicon carbide coated core abrasive crystals and silicon carbide particles. This leached mass is subdivided by crushing or other conventional technique to provide the composite abrasive particles or aggregates of the present invention in admixture with silicon carbide particles. The subdivided mass, then, is subjected to a separation step by screening or other conventional classification technique for separating and recovering the composite abrasive particles or aggregates of the present invention.

Several unexpected and beneficial results of this process are achieved. The silicon carbide coating on the core abrasive particles is in a thickness ranging from about 0.1 to 10 microns with a thickness of about 0.5 to 1 micron being preferred. It will be appreciated that due to the highly rough texture and outer surface conformational irregularity of the particles of the present invention that precise measurements of the coating thickness are difficult and the figures given here, while believed to be accurate, are not a limitation on the present invention. Still, the coating thickness of the silicon carbide on the core abrasive crystal generally is much greater than can be conveniently achieved by formation of silicon carbide coatings deposited on the core abrasive crystals by conventional vapor deposition techniques. Additionally, the silicon carbide coating is very tightly bonded to the core crystal. Thicker coatings are possible if the vapor process is carried out for long periods of time. Vapor deposition is inherently a slow process since the layer must be built up atom by atom. Additionally, for this reason vapor deposited coatings tend to be smoother or follow the roughness of the substrate. In the present invention, the coating is rougher because the non-diamond carbonaceous coating is rough. Note the difference in the Figures. Further, the random orientation of the silicon carbide crystals is a noted unique feature. Additionally, the silicon carbide crystals in the coating generally are quite small in particle size, especially when compared to silicon carbide which is formed by rection of silicon with the carbon content of diamond, for example.

With respect to the composite aggregates of the present invention, the aggregates are composed of the silicon carbide coated crystals which are interconnected by a silicon carbide matrix in an open structure. This means that channels and passageways run through the aggregates from the interior thereof to the outside. The open structure or porosity of the silicon carbide matrix binding the coated composite abrasive particles is unique and well adapted for bonding of the aggregates in the formation of abrasive elements, for example.

The composite abrasive particles and aggregates of the present invention desirably are used in the formation of abrasive elements wherein the coated abrasive particles or aggregates are embedded in a bonding matrix for formation of an abrasive element which preferably is a grinding element. The novel composite abrasive particles and aggregates of the present invention in such use provide much better mechanical bonding of the abrasive particles to the matrix as well as much better bonding of the silicon carbide coating to the core abrasive crystals, especially when the composite abrasive particles of the present invention are compared to conventional metal coated abrasive particles. Further, the silicon carbide coating provides an area of wear resistance about the core abrasive particle which is intermediate between the core abrasive crystal itself and the bonding matrix. This further contributes to the retention of the composite abrasive particles and aggregates in the bonding matrix during use of the abrasive elements, since it reduces erosion of the bonding matrix around the diamond/CBN crystals by workpiece chips generated in the grinding action.

A variety of conventional bonding matrices may be used to bond the composite abrasive particles and aggregates of the present invention. Such conventional bonding matrices include resin, metal, and vitreous materials.

The resin most frequently used in resin-bonded grinding elements or other abrasive elements is a phenol-formaldehyde reaction product. However, other resins or organic polymers may be used such as melamine or urea-formaldehyde resins, epoxy resins, polyesters, polyamides, and polyimides. A resinoid grinding wheel with the composite abrasive particles and aggregates of the present invention can be formed, for example, in the manner as taught in U.S. Pat. No. 3,645,706. Note that the silicon carbide coating can be added to the abrasive element at the expense of secondary abrasive particles customarily in resin grinding elements without detrimentally effecting the performance of the grinding element. The improved resinoid grinding elements of the present invention having diamond as the core crystal are particularly useful in the wet or dry grinding of various workpieces and especially in grinding non-ferrous materials such as cemented tungsten carbide and cemented tungsten carbide/steel combinations.

It is feasible to modify the composite abrasive particles or aggregates of this invention by coating techniques. They could be coated with a metal (eg. nickel or copper) over the silicon carbide coating by any of the well known techniques such as electroless coating (see U.S. Pat. Nos. 3,556,839 and 3,957,461 Example 6 and Lowenhein, F. A., *Electroplating*, Chapters 17 and 19, McGraw Hill Book Co. (1978)). Further references to various metals which are suitable for coating the particles of the present invention can be found in U.S. Pat. No. 3,957,461 (see especially column 8).

The volume percent concentration of coated abrasive particles, when used in a resin bond matrix, is normally between about 5 and 35 percent.

The aggregates as described herein also can be infiltrated with metal (eg. silver or copper) by: (a) mixing them with metal powder; and (b) furnace heating the mixture (preferably under non-oxidizing conditions) at sufficient temperature to melt the metal allowing it to infiltrate into the interstices of the aggregates. the resulting infiltrated masses may be milled and sieved to size. Two infiltration processes known to the art are described in U.S. Pat. Nos. 2,216,728 Example I and 4,024,675.

For further details as to suitable metal, resin, and vitreous matrices for bonding the composite abrasive particles and aggregates of the present invention, reference is made to U.S. Pat. Nos. 2,137,329; 2,561,709; 3,203,775; and 3,894,673 for metals; 3,385,684; 3,664,819; 3,779,727; and 3,957,461 for resins; and 2,216,728 (page 3) for vitreous bond. Metal bonded grinding elements can be used in glass edging, lens generating, grinding ceramics and other non-metallic materials as well as other articles as is well known in the art. A variety of ferrous and non-ferrous metals and alloys can be suitably ground with vitreous bonded grinding elements also.

The following example shows how the present invention can be practiced, but should not be construed as limiting. In this application, all units are in the metric system, all mesh sizes are in U.S. standard sieves series, and all proportions are by volume, unless otherwise expressly indicated. Also, all references cited herein are expressly incorporated herein by reference.

EXAMPLE

Wet Grinding Tests

Abrasive Preparation

Two abrasives were silicon carbide coated:

140/170 mesh (106/90 micron) resin bond diamond obtained as RVG from General Electric Company 140/170 mesh metal bond diamond obtained as MGB from General Electric Company Each was non-diamond carbon coated by pyrolyzing methane at about 1200° C. The coating weight was about seven percent (7%) by weight for both abrasives.

Each coated abrasive was silicon infiltrated according to U.S. Pat. No. 4,200,455 and the improvements in application Ser. No. 230,219, filed Feb. 2, 1981, which is incorporated by reference herein. Each carbon coated abrasive was mixed with fibrous graphite (which had previously been heat treated for 1–5 minutes at 1300° to 1550° C. under a vacuum of less than about 1 Torr) in the approximate weight ratio 100:6 coated diamond to fibrous graphite. This mixture was placed into a hexagonal boron nitride coated graphite mold with a diamond concentration of about 28 percent (28%) by volume. The mixtures then were silicon infiltrated. The infiltrated bodies were placed in a bath of nitric acid and hydrofluoric acid in a volume ratio of about 9:1. This bath was heated to about 120° C. and held at this temperature until no further reaction was evident, about 4 hours. The resulting friable mass was rinsed in water, dried, and lightly crushed in a mortar and pestle. Because of the low diamond concentation, only light crushing was requied to separate the silicon carbide coated diamond particles. Particles larger than about 140 U.S. mesh were sieved out and acid treated as before until no further reaction was evident, about 30 minutes. These particles were rinshed in water and dried. The 100/140 mesh particles were sieved out and used for the grinding tests. The particles essentially consisted of individual 140/170 mesh diamond grits uniformly coated with silicon carbide.

The silicon carbide coating level was measured by chemically removing the silicon carbide from a representative sample in fused potassium hydroxide. The result in percent by weight was as follows:

| Type | SiC Coating Level (%) |
|---|---|
| Resin Bond Diamond | 36 |
| Metal Bond Diamond | 23 |

Preparation of Grinding Wheels

1A1 type peripheral grinding wheels containing each type of abrasive and 140/170 mesh RVG uncoated, resin bond diamond for comparison were made. All wheels contained diamond at 22.5 percent by volume concentration and were 125 mm diameter, 9.5 mm wide and a 9.5 mm thick abrasive section. The wheels were phenolic resin bonded with fine SiC secondary abrasive in a 1:25 weight ratio to the resin. A minimum of two wheels containing each abrasive type was tested.

Grinding Tests

Wet grinding tests were run on a Norton surface grinder. A BioCool 500 (a rust inhibitor) and water mixture was used as the coolant. The workpiece material was Carboloy Grade 370 cemented carbide; a wear resistant grade with a composition by weight of WC 72%, TiC 8%, TaC 11.5%, and Co 8.5%.

Prior to testing, each wheel was mounted on the grinder and trued using a silicon carbide wheel on a brake-controlled trueing device. The wheel was subjected to a preconditioning grind until energy requirements and rate of wheel wear had stabilized.

Testing was done at the following conditions:

Wheel Speed: 24.5 m/sec
Table Speed: 15.0 m/min
Downfeed: 0.038 mm
Crossfeed: 1.27 mm
Workpiece Size: 145 $cm^2$

Grinding Test Results

The grinding test results are expressed in terms of grinding ratio, GR, which is defined as the volume of workpiece material removed divided by the volume of wheel consumed. GR is a measure of wheel efficiency.

The grinding test results were as follows. The GR reported is the average of two wheels with a minimum of 3 tests per wheel.

| Abrasive Type | Grinding Ratio | Rel. GR* |
|---|---|---|
| Uncoated resin bond diamond | 50 | 1.0 |
| Resin bond diamond | 120 | 2.4 |
| Metal bond diamond | 38 | 0.76 |

*Rel. GR is the relative grinding ratio, calculated by dividing the grinding ratio for each abrasive type by the GR for the uncoated abrasive.

As can be seen, the GR of SiC coated resin bond diamond is unexpectedly large compared to uncoated resin bond diamond. Metal bond diamond is not recommended for grinding cemented carbide since it is less friable and, thus, does not remain sharp. SiC coated metal bond diamond also has this disadvantage. This is evidence that the coating process does not degrade the metal bond crystal to where its grinding performance is affected.

I claim:

1. An improved composite abrasive particle comprising a core abrasive crystal and a silicon carbide coating adherently bonded thereto, said silicon carbide coating being conformationally irregular and comprising silicon carbide crystals having a random orientation substantially independent of the structure of said core abrasive crystal and made by the steps comprising:
   (a) providing core crystals coated with non-diamond carbonaceous material;
   (b) infiltrating said crystals with fluid silicon under a partial vacuum at a temperature of about 1400° C., cooling and recovering the resulting mass of core crystals bonded together by a bonding medium of silicon carbide and elemental silicon, the outer surfaces of said core crystals having silicon carbide adherently bonded to substantially all of the exterior surfaces thereof;
   (c) leaching substantially all of said silicon from said bonded mass with a silicon leaching agent; and
   (d) sub-dividing the resulting leached mass and recovering said composite abrasive particles.

2. The improved composite abrasive particle of claim 1 wherein said core abrasive crystal is selected from the group consisting of diamond and cubic boron nitride.

3. The improved composite abrasive particle of claim 1 which is further coated with a metal.

4. The improved composite abrasive particle of claim 3 wherein said metal is selected from the group consisting of nickel and copper.

5. A porous composite abrasive aggregate comprising core abrasive crystals disposed within a silicon carbide matrix, said silicon carbide adherently bonded to substantially all of the exterior surfaces of each of said core crystals, said silicon carbide matrix being porous, conformationally irregular, and comprising silicon carbide crystals having a random orientation substantially independent of the structure of the core abrasive crystals and made by the steps comprising:
   (a) providing core crystals coated with non-diamond carbonaceous material;
   (b) infiltrating said crystals with fluid silicon under a partial vacuum at a temperature of above 1400° C., cooling and recovering the resulting mass of core crystals bonded together by a bonding medium of silicon carbide and elemental silicon, the outer surfaces of said core crystals having silicon carbide adherently bonded to substantially all of the exterior surfaces thereof;
   (c) leaching substantially all of said silicon from said bonded mass with a silicon leaching agent; and
   (d) recovering said composite abrasive aggregates.

6. The composite abrasive aggregates of claim 5 wherein said core crystals are selected from the group consisting of diamond and cubic boron nitride.

7. The porous composite abrasive aggregate of claim 5 which is coated with a metal or infiltrated with a metal.

8. The porous composite aggregates of claim 7 wherein said metal is selected from the group of nickel and cooper.

9. An improved abrasive element of coated abrasive particles embedded in a bonding matrix, wherein the improvement comprises coated abrasive particles comprising core crystals selected from the group consisting of diamond and cubic boron nitride, and an irregular silicon carbide coating adherently bonded to substantially all of the exterior surfaces of said core crystals, said silicon carbide coating characterized by silicon carbide crystals which are conformationally irregular and have a random orientation substantially independent of the structure of said core abrasive crystal and made by the steps comprising:

(a) providing core crystals coated with non-diamond carbonaceous material;

(b) infiltrating said crystals with fluid silicon under a partial vacuum at a temperature of above 1400° C., cooling and recovering the resulting mass of core crystals bonded together by a bonding medium of silicon carbide and elemental silicon, the outer surfaces of said core crystals having silicon carbide adherently bonded to substantially all of the exterior surfaces thereof;

(c) leaching substantially all of said silicon from said bonded mass with a silicon leaching agent; and (d) sub-dividing the resulting leached mass and recovering said composite abrasive particles.

10. The improved abrasive element of claim 9 wherein said bonding matrix is selected from the group consisting of a cured resinuous material, metal, and a vitreous material.

11. The improved abrasive element of claim 9 wherein said coated abrasive particles comprise porous composite abrasive aggregates of said core abrasive crystals in a matrix of silicon carbide which interconnects said silicon carbide coated core crystals.

* * * * *